US007661259B2

(12) United States Patent
Griesshammer et al.

(10) Patent No.: US 7,661,259 B2
(45) **Date of Patent: *Feb. 16, 2010**

(54) DEVICE AND METHOD FOR THE MANUFACTURE OF A ROVING YARN BY MEANS OF AIR SPINNING PROCESSES

(75) Inventors: Christian Griesshammer, Winterthur (CH); Herbert Stalder, Kollbrunn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 413 days.

This patent is subject to a terminal disclaimer.

(21) Appl. No.: 10/571,416

(22) PCT Filed: Jul. 16, 2004

(86) PCT No.: PCT/CH2004/000454

§ 371 (c)(1),
(2), (4) Date: Jan. 25, 2007

(87) PCT Pub. No.: WO2005/026421

PCT Pub. Date: Mar. 24, 2005

(65) Prior Publication Data

US 2007/0193245 A1 Aug. 23, 2007

(30) Foreign Application Priority Data

Sep. 12, 2003 (CH) ..... 1579/03

(51) Int. Cl.
*D02G 3/34* (2006.01)

(52) U.S. Cl. ..... 57/209; 57/317; 57/350

(58) Field of Classification Search ..... 57/209, 57/317, 350, 403

See application file for complete search history.

(56) References Cited

U.S. PATENT DOCUMENTS

| | | | | |
|---|---|---|---|---|
| 3,722,198 | A * | 3/1973 | Gotzfried | 57/403 |
| 4,700,538 | A | 10/1987 | Varga et al. | |
| 4,858,420 | A | 8/1989 | Stahlecker et al. | |
| 2003/0056488 | A1 * | 3/2003 | Raasch | 57/400 |
| 2007/0144136 | A1 * | 6/2007 | Griesshammer et al. | 57/315 |

FOREIGN PATENT DOCUMENTS

| | | | |
|---|---|---|---|
| CH | 572113 | | 12/1975 |
| CH | 617465 | | 5/1977 |
| DE | 3237989 | C2 | 10/1986 |
| EP | 375242 | A2 | 12/1989 |

* cited by examiner

*Primary Examiner*—Shaun R Hurley
(74) *Attorney, Agent, or Firm*—Dority & Manning, P.A.

(57) ABSTRACT

The invention relates to a slubbing machine, the use of a twist application means, and a method for the manufacture of a roving yarn (9). The roving yarn (9) is manufactured according to the invention from a fiber assembly (3), which undergoes a true twist application (rotation) by mean of one or more air flows.

17 Claims, 7 Drawing Sheets

I-I

DEVICE AND METHOD FOR THE MANUFACTURE OF A ROVING YARN BY MEANS OF AIR SPINNING PROCESSES

FIELD OF THE INVENTION

The present invention relates to an apparatus and method for manufacturing of a roving yarn from a fiber assembly. Particularly, the present invention relates to the use of a twist application component that at least partially subjects a fiber assembly to a true twist by an air flow. The present invention also relates to a drawing frame and slubbing machine combination. Such devices are known in the textile technology.

BACKGROUND OF THE INVENTION

Slubbing machines according to the present disclosure are often speed frames. A speed frame serves to manufacture roving yarn. Roving yarn may also be referred to as slubbing or roving. The roving yarn serves as the basis for the spinning process which includes the spinning of fibers into a fiber yarn, for example on a ring-spinning machine.

The process for manufacturing a roving yarn may include the following steps. First, the fiber bands coming from the preliminary process (carding room) are doubled with the aid of drafting devices and deposited in cans. The fiber assembly produced by this process is then presented to the stubbing machines for further processing. In these slubbing machines, the fiber assembly is first drawn through a drafting device and then slightly twisted by the application of a suitable twist. The fiber assembly is then wound up as a roving yarn on a supply bobbin. The roving yarn, also referred to as the fiber stubbing, the flyer slubbing, or generally as the slubbing, manufactured according to this process usually serves as presentation material for ring-spinning machines.

A slubbing machine usually includes its own drafting device. In most cases, this drafting device is a double apron drafting device. After being drawn through the drafting device, the fiber assembly undergoes a slight twist, also referred to as a protective twist, in order for the slubbing to exhibit sufficient strength to be wound on a bobbin without disintegrating. The twist must only be of sufficient strength for the fiber assembly to be held together for the winding and later unwinding of the fiber assembly and for the transport of the bobbins. The twist must also be sufficiently strong to avoid wrong draftings (thin places in the roving yarn). On the other hand, the twist must be easy to be released again so that the roving yarn is capable of being drawn for the subsequent spinning process, for example in a ring-spinning machine.

A speed frame is often used as a slubbing machine to manufacture flyer slubbing. The speed frame is equipped with a drafting device and a spindle for winding up the flyer slubbing onto a cylinder bobbin by means of a flyer which supports the slubbing against the centrifugal force incurred by the bobbin revolutions. The speed frame is an expensive machine in the spinning process as a whole, due to the complicated winding mechanism. In addition, the usual output from a speed frame is about 20-25 meters of roving yarn per minute. This low production cannot be increased in view of the winding system with flyers because a higher speed is limited by the centrifugal force which the flyers and roving bobbin must withstand.

Attempts have been made to bypass the use of the slubbing machine by direct spinning In this process, a ring-spinning machine is supplied with a fiber sliver. The high draft produced by sliver direct spinning only achieves the result to a restricted degree compared to that obtained with the supply of a flyer stubbing on a ring spinning machine. This is particularly true if fine yarns of 50 Nm and finer are being spun. In addition, the supply fiber slivers to ring-spinning machines is elaborate and complicated.

One possibility for replacing a speed frame slubbing machine is disclosed in the European Patent Application No. EP 375 242 A2. This publication describes a machine for the manufacture of a roving yarn from a fiber assembly which has a twist application means utilizing a rotating rotor. The rotor exhibits a continuous longitudinal hole on its axis of rotation, through which the fiber assembly that is to be rotated is guided. The rotor has at a specific height several holes arranged rotationally symmetrically. These radial holes connect the longitudinal hole with the outer surface of the rotor. The outer surface of the rotor is subjected to a vacuum or a strong under-pressure. As the fiber assembly is drawn through the longitudinal hole, individual free fiber ends are sucked off the surface of the fiber assembly into the radial holes. In operation, the rotor rotates while the fiber assembly is drawn through the longitudinal hole. The fiber ends located in the radial holes are wound around the moving fiber assembly. As a result, a rotation or true twist is applied to the fiber assembly. The device according to the process described is relatively expensive in manufacture and operation due to the mechanical elements (rotating rotor) and the vacuum technology.

De 32 37 989 C2 teaches the principle of drawing a fiber stubbing or drawing sliver in a drafting device and then applying a twist to the drawn fiber assembly. The application of the twist is effected by air jets in two sequential twist chambers. The application of the twist in the first pneumatic twist chamber is performed in a direction counter to the application of twist in the second pneumatic twist chamber. For example, the first twist application causes, a left-hand rotation, while the following twist application in the second twist chamber causes a right-hand rotation. A yarn manufactured in this manner is produced in accordance with what is known as the false twist process.

Patent Specification CH 617 465 teaches a false twist nozzle used for the manufacture of a staple fiber yarn, which is also a false twist spinning process. During the production of a yarn, the individual fibers are twisted together to the extent that the twisting is irreversible, and the yarn produced cannot be drawn any further. The strengthening achieved by the twisting is necessary because it is the only way the yarn will obtain the necessary high tensile strength. The consequence of this, however, is that the devices and spinning processes referred to are not suitable for forming a roving yarn. The roving yarn exhibits only what is referred to as a protective twist, which must not impede the further spinning processes on following machines, for example the process of drafting on ring-spinning machines. The devices described in these two aforementioned publications are therefore only suitable for the manufacture of yarns and are not suitable for manufacturing a roving yarn that remains capable of being drafted.

An object of the present invention is to provide a stubbing machine and method for the manufacture of a roving yarn that avoids the disadvantages referred above and exhibits the characteristics of conventional flyer slubbings or roving yarns.

SUMMARY OF THE INVENTION

A summary of exemplary embodiments of the present invention will be set forth here. Using the description provided herein, one skilled in the art will understand that additional exemplary embodiments are within the scope of the present invention.

One exemplary embodiment of the present disclosure provides a stubbing machine for the manufacture of a roving yarn from a fiber assembly. The slubbing machine has at least one spinning position. The spinning position includes twist application component for twisting the fiber assembly to form a roving yarn. For this purpose, the twist application component exhibits a swirl chamber. In alternate embodiments of the present disclosure, the swirl chamber may include a roving yarn formation element. The roving yarn formation element may be a spindle. In the swirl chamber of the twist application component, a true twist or rotation is at least partially applied to the fiber assembly by an air flow. The twist may be a protective twist the result of which the roving yarn remains capable of being drafted.

In variations of this exemplary embodiment, the twist application component may include a second roving yarn formation element. This second roving yarn formation element may be a spindle. This exemplary embodiment may also provide several swirl chambers with correspondingly several means for the formation of an air flow (see, for example, FIG. 3*b*).

In another variation of this exemplary embodiment, the twist application component has one or more twist stops. These twist stops can be designed, for example, as edges, pins, toroidal surfaces, cones, or as one of several deflection surfaces. The twist application component may exhibit a combination of the twist stops just referred to, such as a toroidal surface with a pin, a cone with a pin, an edge with a pin, or a toroidal surface with a pin.

In yet another variation of an exemplary embodiment of the present disclosure, the twist application component includes several nozzles for the production of the air flow, the nozzles being arranged in such a way that the air jets emerging from the nozzles create a single, unidirectional air flow. This applies in particular in embodiments of the present disclosure which include several swirl chambers. Preferably, the nozzles are arranged rotationally symmetric (as shown in FIG. 2) about the axes of the swirl chambers. In exemplary embodiments in which several swirl chambers are present, the nozzles holes may be arranged both rotationally symmetric about the axes of the swirl chambers as well as rotationally symmetric offset on an axis (as shown in FIG. 3B) of the swirl chambers so that the entry angles of the nozzle holes are the same. However, in exemplary embodiments where several swirl chambers are present, the nozzles may also be arranged in such a way that the nozzles of an individual swirl chamber are indeed rotationally symmetric about the axes of the swirl chamber, but each swirl chamber exhibits a different entry angle for the individual nozzles. In this case, the air jets emerging in the individual swirl chambers remain directed in the same direction, in the sense of a left or right rotation, but have different "lead angles". If the air jets arising in different swirl chambers exhibit different "lead angles", the twist which is applied by the resulting airflow nevertheless remains in the same direction. Accordingly, the fiber assembly respectively undergoes a left twist or a right twist in all swirl chambers.

In a further variation of this exemplary embodiment, the twist application component includes a funnel or an aerodynamic or mechanical condenser, which has the function of restricting the width of the fiber assembly as it is led to a twist application component.

In still a further variation of this exemplary embodiment, the distance between the intake aperture of the roving yarn formation element and the last nip line is not greater than the longest fiber length obtained in the fiber assembly or greater than the medium staple fiber length of the fiber assembly.

In still a further variation of this exemplary embodiment, the distance interval between the inlet of the twist application means and the last nip line is not greater than the longest fiber length obtained in the fiber assembly.

In still a further variation of this exemplary embodiment, a drafting device may be arranged up stream of the stubbing machine.

In still a further variation of this exemplary embodiment, the slubbing machine includes a winding device downstream from the twist application component. The winding device winds up the roving yarn emerging from the twist application component. The winding device may be a cross-winder, a precision cross-winder, a random cross-winder, a step precision cross-winder, or a parallel winder.

In yet another exemplary embodiment of the present invention, the twist application component only applies a protective twist to the fiber assembly so that the roving yarn remains capable of being drafted. The twist may be removed again for the further processing. For example the twist may be removed again for processing the roving yarn into a ring-spun yarn.

Another exemplary embodiment of the present disclosure includes a method for the manufacture of a roving yarn from a fiber assembly. Under this method, the fiber assembly is first drafted and then at least partially subjected to a twist application or rotation. This twist application is a true twist and is produced by means of a single air flow in a swirl chamber.

In a variation of this exemplary embodiment, several nozzles may be present for the production of the air flow. The nozzles are preferably arranged in such a way that the emerging air jets produce a single unidirectional airflow. For this purpose, the nozzles are preferably arranged rotationally symmetric around one axis (see FIG. 2) or rationally symmetric offset around one axis (see e FIG. 3*b*).

Still another exemplary embodiment of the present disclosure includes a drawing frame-slubbing machine combination. This combination includes a conventional drafting frame for doubling and drafting several fiber assemblies. The conventional drafting frame arranged upstream of a slubbing machine. The slubbing machine is designed according to the exemplary embodiments of the present disclosure discussed herein.

None of the exemplary embodiments of the present disclosure discussed herein utilize a false twist process for manufacturing a roving yarn from a fiber assembly.

The present disclosure is not restricted to the possibilities and embodiments described herein. Rather, the variations of the exemplary embodiments discussed above are intended to be incentives for the person of ordinary skill in the art to implement the idea of the invention in as favorable a manner as possible. Accordingly, further advantageous embodiments and combinations can be easily derived from the embodiments described and shown herein. The applicants therefore expressly reserve the right to make provision for such further advantageous embodiments and combinations.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE DRAWINGS

Objects and advantages of the invention will be set forth in the following description, or may be apparent from the description, or may be learned through practice of the invention.

Figure 1:
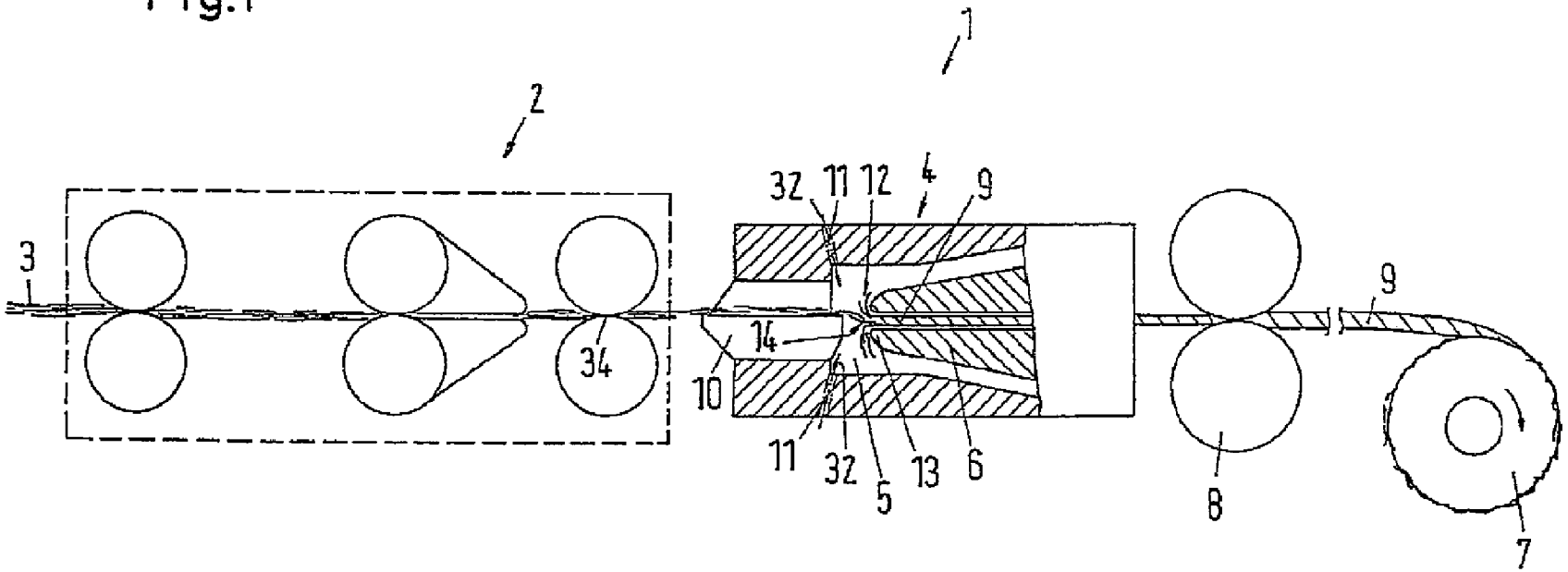
FIG. 1 shows in diagrammatic form a spinning position of a slubbing machine (entire slubbing machine not shown) according to an exemplary embodiment of the present disclosure.

FIG. 1 shows in diagrammatic form a spinning position 1 of a stubbing machine (entire slubbing machine not shown) according to an exemplary embodiment of the present disclosure. This exemplary embodiment exhibits a drafting device 2 which is supplied with a fiber assembly 3. The fiber assembly 3 may for example be a doubled sliver. The drafted fiber assembly 3 passes from the drafting device into the twist application component 4. In the twist application component 4, the fiber assembly 3 is twisted to form a roving yarn 9. In particular, the fiber assembly 3 is at least partially subjected to a true twist.

FIG. 1 also shows a pair of delivery rollers 8 with a nip line 34 and a winding device 7 for the roving yarn 9. However, those of ordinary skill in the art will understand that the present disclosure does not require a drafting device 2 or a pair of delivery rollers 8 as represented in FIG. 1. For example, in addition to or as a substitute for the drafting device 2, a conventional drawing frame can be provided inside the same machine (hereinafter referred to as drawing frame-slubbing machine combination). A drawing frame-slubbing machine combination has the advantage of shortening the process for the manufacture of a roving yarn.

The twist application component 4 operates according to the Vortex process, a special air-spinning method. The Vortex air-spinning method is an inherently known yarn spinning process. As described above, current devices for the forming of yarn are unsuitable for the manufacture of a roving yarn that remains capable of being drafted. Surprisingly and unexpectedly, experiments with suitably modified air-spinning devices have revealed that certain air-spinning methods are suitable for the manufacture of roving yarns. To achieve this, however, the dimensions and flow circumstances of conventional yarn air-spinning devices must be adapted. In particular the twist application means need only apply a protective twist to the fiber assembly for the slubbing or roving yarn to remain capable of being drafted. As discussed above, conventional air-spinning devices rotate the fiber assembly so that the yarn or thread is strongly twisted in such a way that the twist is irreversible and is no longer capable of being drafted. By providing correspondingly larger dimensions for the air-spinning devices, as well as an adjustment of the flow characteristics, in particular by suitably high delivery speeds, it is possible to manufacture roving yarns or slubbings capable of being drafted with air-spinning devices. The appropriate characteristics are best determined experimentally. According to initial experiments, air-spinning devices for roving yarns preferably show one or more of the following properties:

The diameter of the twist or swirl chamber 5 amounts to at least 5 mm.

The delivery speed of the fiber assembly from the delivery rollers of the drafting device amounts to at least 200 m/min The pressure of the air flow before it flows through the nozzle holes or nozzles into the swirl chamber amounts to a maximum of approximately 5 bar.

The air-spinning devices should administer a deep wrapping rotation to the roving or stubbing. The wrapping rotation and the coefficient of rotation $alpha_m$ preferably is less than 100.

The mode of operation for exemplary embodiments of the present disclosure is similar to that of conventional air-spinning methods for the formation of yarn. For this reason, air-spinning methods are not discussed here in any great detail. By contrast with conventional air-spinning devices, the devices and methods according to exemplary embodiments of the present disclosure only apply a protective twist to the fiber assembly. This protective twist is of such a nature that the roving yarn remains capable of being drafted for further processing. In contrast to the twist to which a fiber assembly would be subjected to with conventional air-spinning devices, the application of the twist according to exemplary embodiments of the present disclosure can be reversed. To form the roving yarn, the fiber assembly is subjected at least in part to a true twist by an airflow. This true twist is, as mentioned, only a protective twist. The roving or stubbing manufactured according to exemplary embodiments of the present disclosure therefore has the same properties as a slubbing manufactured with a conventional speed frame.

One exemplary embodiment a twist application component 4 according to the present disclosure is shown in FIG. 1. The twist application component 4 operates according to what is known as the Vortex air-spinning method. The twist application component 4 includes a fiber guide element 10, with which the fiber assembly 3 is delivered into the swirl chamber 5 of the twist application component 4. In the swirl chamber 5, a fluid device, not represented in greater detail, creates an air flow 32 by one or more nozzles 11. The resulting swirl air flow inside the swirl chamber 5 causes the individual free fiber ends 12 to lie on the surface of the fiber assembly 3 around the inlet aperture 13 of a roving yarn formation element 6. The free fiber ends 12 are taken up by the rotating swirl flow in the swirl chamber and are rotated around the core 14 of the fiber assembly. As a result, the fiber assembly 3 in the swirl chamber 5 is subjected at least partially to a true twist by an air flow 32. Specifically, this air flow causes some of the individual fibers to be subjected to a true twist about a core of fibers. The roving yarn 9 which is formed at the inlet aperture 13 is drawn off by a pair of delivery rollers 8 and wound up onto a winding device 7. To do this, the roving yarn formation element 6 exhibits a hole (see FIG. 1). Using the teachings disclosed herein, those of ordinary skill in the art will appreciate that the scope of the present invention is not limited to the particular winding device 7 depicted in FIG. 1. For example, the winding device can be a cross winder, a precision cross-winder, a random cross-winder, a stepped cross-winder, a parallel winder, or other winding device.

Figure 2:
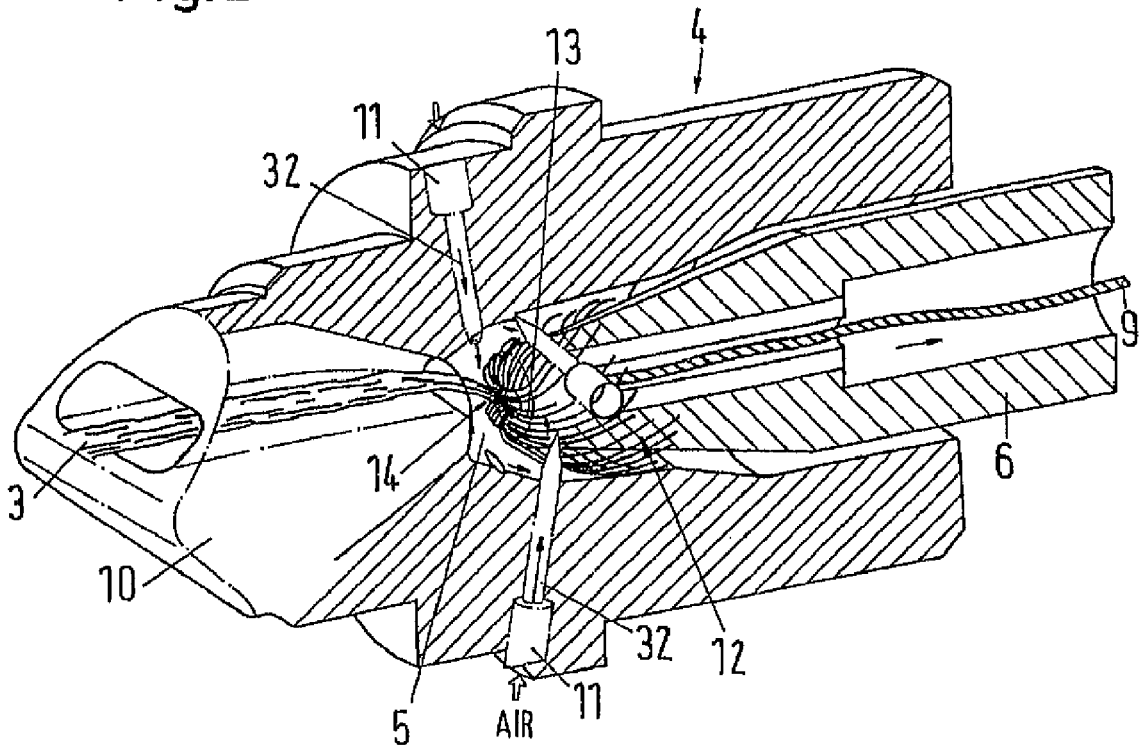
FIG. 2 shows a sectional view of the twist application component shown in FIG. 1.

FIG. 2 depicts a sectional view of the twist application component 4 shown in FIG. 1. FIG. 2 illustrates how the fiber assembly 3 is guided by the fiber guide element 10 into the swirl chamber 5. In the swirl chamber 5, a swirl air flow created by the nozzle holes 11 takes up the free fiber ends 12 of the fiber assembly 3 and lays them around the inlet aperture 13 of the roving yarn formation element 6. The free fiber ends 12 lying around the inlet aperture 13 form a "sun" rotating around the core 14 of the fiber assembly. The free fiber ends 12 accordingly twist about the core 14 of the fiber assembly. As a result, the fiber assembly 3 receives at least in part a true twist in the swirl chamber 5. The roving yarn 9 which is formed at the inlet aperture 13 is delivered (see arrow) by the roving yarn formation element 6. The roving yarn formation element 6 used in the exemplary embodiment of the present disclosure shown in FIG. 2 is a spindle.

Figure 3B:
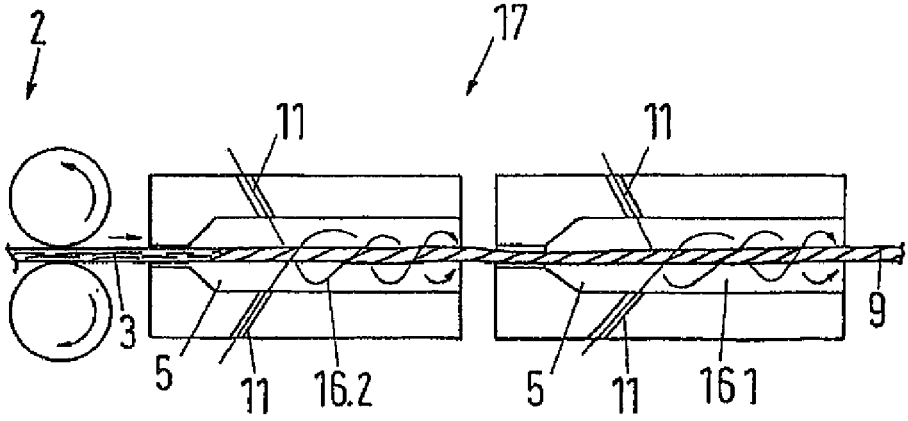
FIG. 3B shows a variant of the twist application shown in FIG. 3A.
Figure 3:
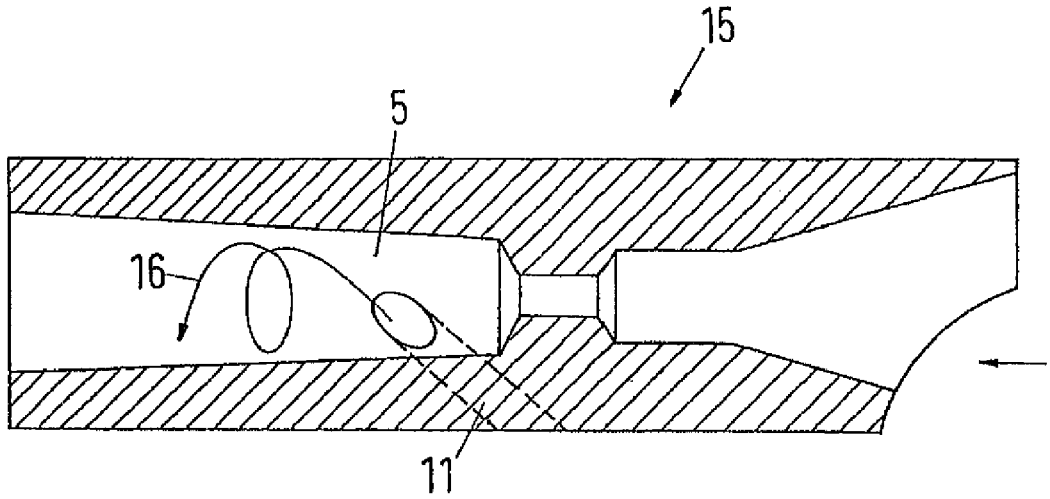
FIG. 3 shows an alternate twist application component according to an exemplary embodiment of the present invention.

FIG. 3 shows another exemplary embodiment of a twist application component 15 according to the present disclosure. Twist application component 15 does not include a roving yarn formation element. The twist application means 15 includes a swirl chamber 5, in which an air flow 16 is created by means of one or more nozzles 11. This air flow 16 subjects the fiber assembly 3 at least partially to a true twist in the swirl chamber 5.

Figure 3A:
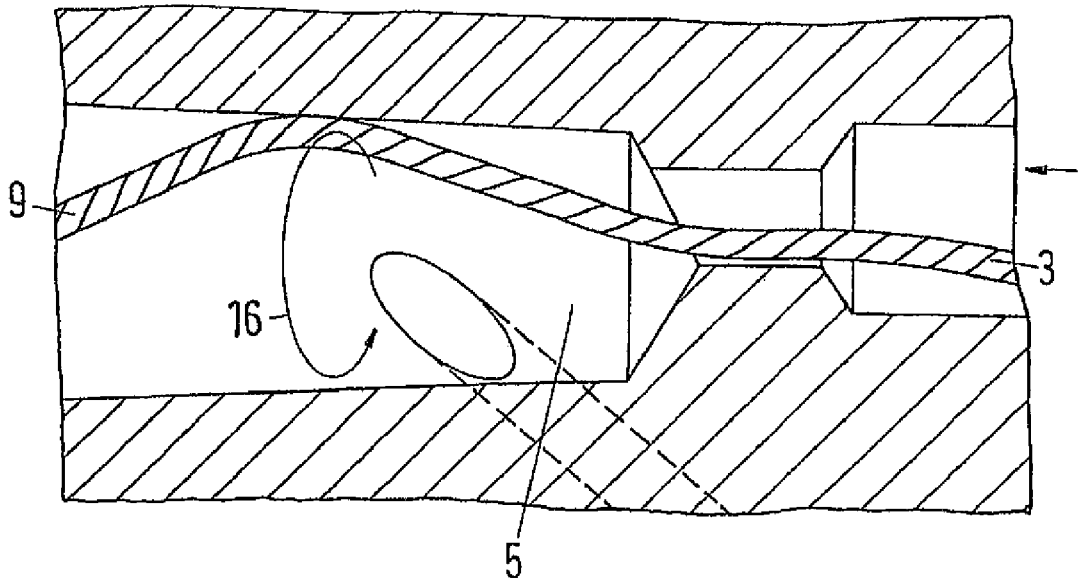
FIG. 3A shows the application of a true twist inside the swirl chamber of the twist application component shown in FIG. 3.

FIG. 3A illustrates the true twist application inside the swirl chamber 5. A rotation is applied to the fiber assembly by the air flow 16. At least a part of the fibers of the fiber assembly 3 are rotated so that the roving yarn 9 is formed.

FIG. 3B shows a variation of the twist application shown in FIG. 3A. The twist application component 17 includes two swirl chambers 5 which do not exhibit a roving yarn formation element. The trite twist is applied in this case by means of one or two air flows 16.1 and 16.2. At least a part of the fibers of the fiber assembly 3 receive a true twist. The twist application component 17 preferably includes several nozzles 11. The nozzles 11 serve to generate the air flows 16.1 and 16.2. The nozzles 11 are aligned in such a way that the emerging air jets jointly and together create air flows 16.1 and 16.2. For this purpose, the inlet angles of the nozzles 11 are preferably the same inside each individual swirl chamber 5. The air flows 16.1 and 16.2 are also directed in the same way. Accordingly, the two air flows 16.1 and 16.2, despite being in separate swirl chambers, have the same direction of rotation.

In the exemplary embodiments of the present disclosure discussed herein, the nozzles 11 are aligned in such a way that the emerging air jets are in the same direction. This alignment creates one parallel air flow with one direction of rotation. Preferably, the individual nozzles or nozzle holes are arranged symmetrically to one another.

A twist application component designed according to exemplary embodiments of the present disclosure may also exhibit one or more twist stops. Twist stops can exhibit different forms. For example, a twist stop may be an edge, a pin, a toroidal surface, a cone, or in the form of several deflection surfaces. Those of ordinary skill in the art will understand that the use of twist stops is not absolutely necessary to practice the claimed invention. The use of twist stops is, however, recommendable because it improves the true twist performed by the air flow.

Figure 4:
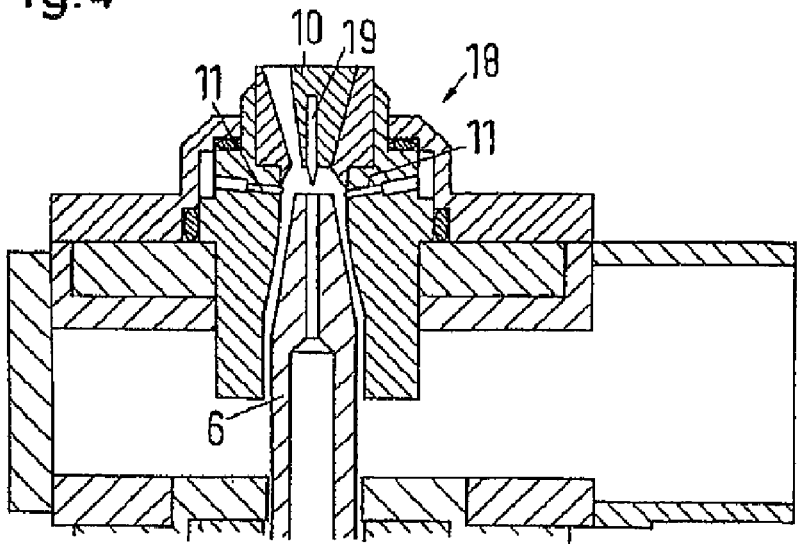
FIG. 4 shows a twist application component with a twist stop in the form of a pin.

FIG. 4 depicts twist application means 18 with a twist stop in the form of a pin 19. The remaining elements in FIG. 4 correspond largely to the embodiments already described herein and accordingly exhibit the same reference numerals. The pin 19 in FIG. 4 serves as a twist stop element as well as a false yarn core. Twist stops serve to prevent a twist in the fiber assembly being propagated upstream of the fiber guide assembly. This prevents any possible false twist from occurring.

Figure 4A:
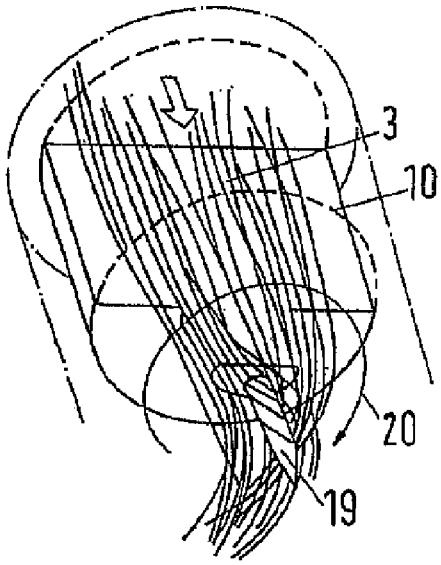
FIG. 4A shows how a pin prevents the twist from propagating further upstream of the fiber guide element.
Figure 4B:
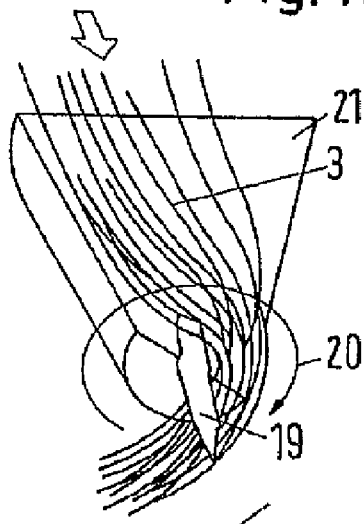
FIG. 4B shows how a pin in combination with a toroidal surface prevents the twist incurred by the air flow from propagating further upstream of the fiber guide element.

As is shown in FIGS. 4A and 4B, the pin 19 prevents the twist incurred by the air flow from propagating upstream of the fiber guide element. This can be seen particularly well in FIGS. 4A, 4B, and 4C. The air flow 20 around the mouth of the roving yarn formation element creates a rotation or a twist inside the fiber assembly 3. Due to the presence of the pin 19 as a twist stop prevents the twisting of the fibers located inside the fiber assembly 3 that are lying on the fiber guide element 10 or fiber guide element 21.

Figure 4C:
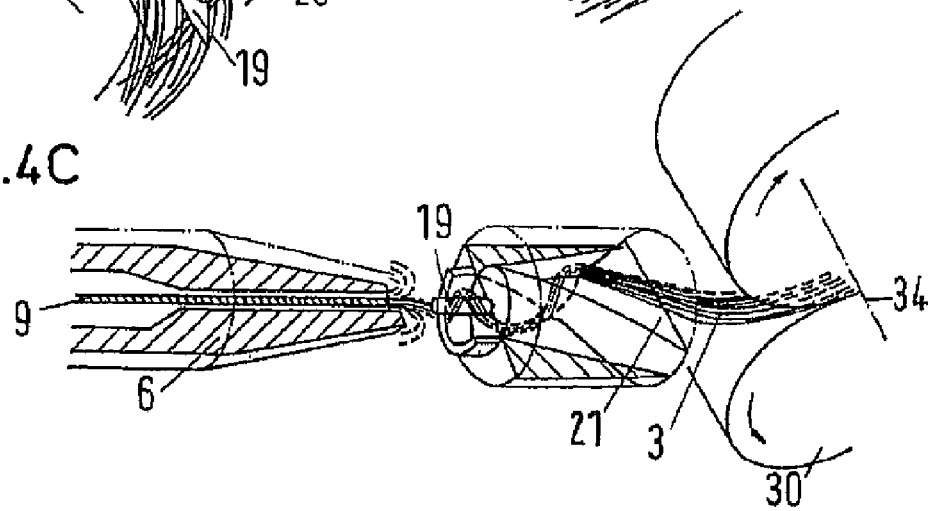
FIG. 4C provides an alternative view of how a pin in combination with a toroidal surface prevents the twist incurred by the air flow from propagating further upstream of the fiber guide element.

A toroidal fiber guide element 21 can also serve as a twist stop element. FIG. 4B shows a toroidal fiber guide element 21 that additionally exhibits a pin 19. A toroidal fiber guide element 21 with pin 19 is also represented in FIG. 4C. The elements in FIG. 4C correspond largely to the elements in FIG. 4B, with the difference that the pin 19 depicted in FIG. 4C is truncated.

Figure 5:
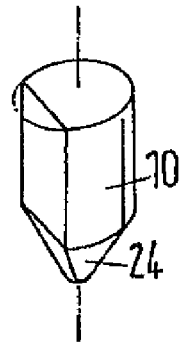
FIG. 5 shows a fiber guide element with a twist stop cone.

FIG. 5 shows a fiber guide element 10 with a twist stop cone 24. The twist stop cone 24 performs the function of a twist stop. The mode of operation is the same as with the pin 19 depicted in FIGS. 4A, 4B, and 4C. The twist stop cone 24 and the pin 19 shown in FIGS. 4A, 4B, and 4C also serve as false yarn cores. The fiber assembly twists in spiral fashion around the false yarn core thereby preventing the twist from propagating further upstream of the fiber guide assembly.

Figure 6:
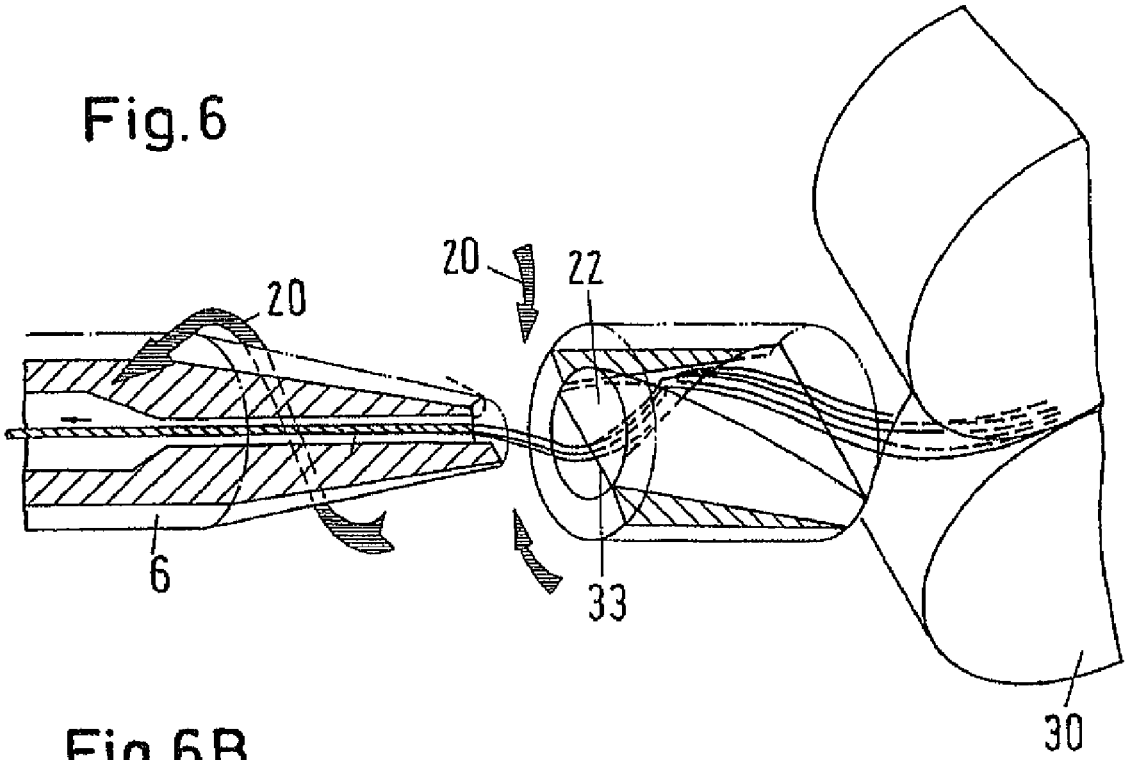
FIG. 6 shows a twist stop consisting of a toroidal surface without a pin.
Figure 6B:
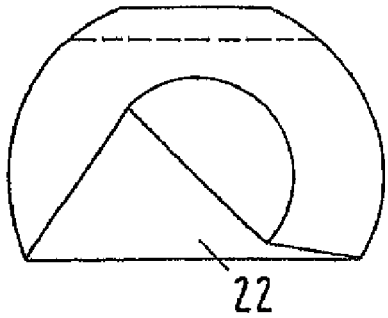
FIG. 6B shows an alternative view of a twist stop consisting of a toroidal surface without a pin.
Figure 6A:
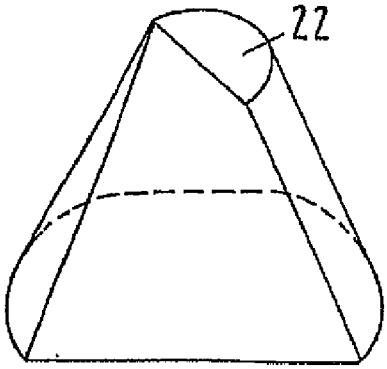
FIG. 6A shows an alternative view of a twist stop consisting of a toroidal surface without a pin.

FIG. 6 depicts a twist stop consisting of one toroidal fiber guide element 22 without a pin. A toroidal fiber guide element is inherently sufficient as a twist stop. Accordingly, the additional use of a pin is not necessary. Different views of the toroidal fiber guide element 22 without pin are shown in FIGS. 6A and 6B.

Those of ordinary skill in the art should appreciate, using the teaching herein, that it is also possible for only an edge 33 to serve as a twist stop. The edge 33 does not necessarily have to project from a toroidal fiber guide element to serve as a twist stop element.

Figure 7:
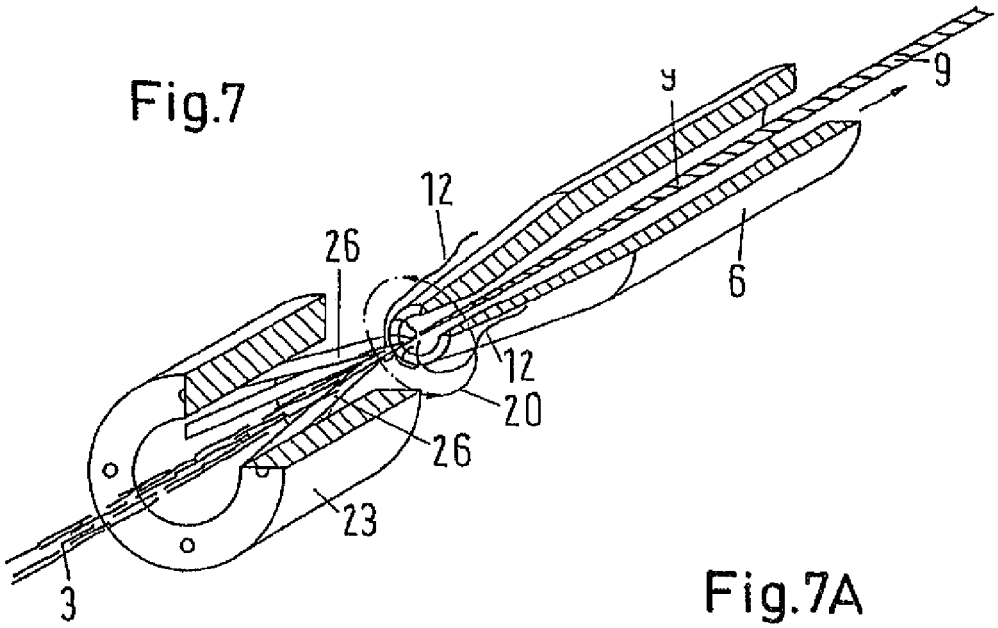
FIG. 7 shows a fiber guide element with deflection surfaces acting as a twist stop.

FIG. 7 shows additional twist stops which may be used according to exemplary embodiments of the present disclosure. FIG. 7 depicts a fiber guide element 23 with several deflection surfaces. In addition to deflecting the fiber assembly 3, the deflection surfaces 26 have the function of a twist stop. The fiber assembly is drawn in the non-twisted state in the direction of the roving yarn formation element 6. At the mouth of the roving yarn formation element 6, the free fiber ends 12 are twisted by the air flow 20. The twist of the free fiber ends 12 causes a torsion moment, which tries to propagate against the delivery direction of the roving yarn in the fiber assembly 3. Due to the presence of the deflection surfaces 26 as a twist stop, this torsion moment or twist is stopped. As a result, no twist propagates into the fiber assembly 3.

Figure 7A:
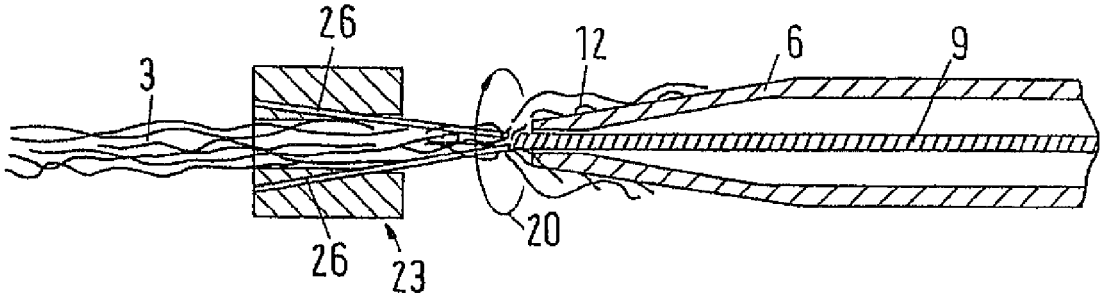
FIG. 7A shows side view of a fiber guide element with deflection surfaces acting as a twist stop.

Without the deflection surfaces 26 acting as a twist stop, the twist would propagate into the fiber assembly 3 and a false twist would occur. This false twist, under certain circumstances, would prevent a true twist of the fiber assembly. FIG. 7A depicts the deflection surfaces 26 acting as a twist stop. FIG. 7 illustrates that the fiber assembly 3 remains untwisted thanks to the deflection surfaces 26.

Figure 8A:
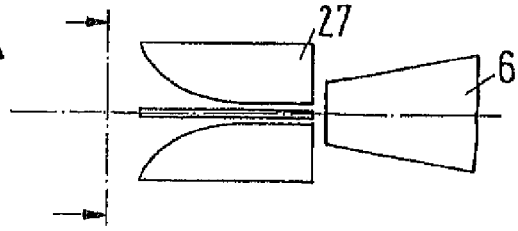
FIG. 8A shows alternate deflection surfaces acting as a twist stop.
Figure 8C:
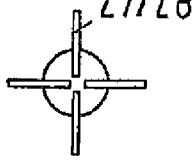
FIG. 8C shows an end view of deflection surfaces shown in FIGS. 8A and 8B.
Figure 8B:
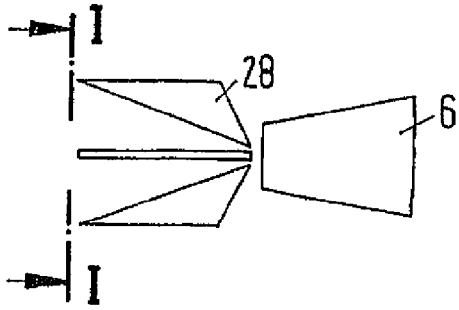
FIG. 8B shows alternate deflection surfaces acting as a twist stop.

FIGS. 8A and 8B show deflection surfaces 27 and 28 that can also act as twist stops. FIG. 8C provides an end view of the deflection surfaces 27 and 28. The deflection surfaces 26, 27 and 28 shown represent only some of the possible forms of deflection surfaces. Using the teachings disclosed herein, other deflection surfaces known in the art may also be used.

Figure 9:
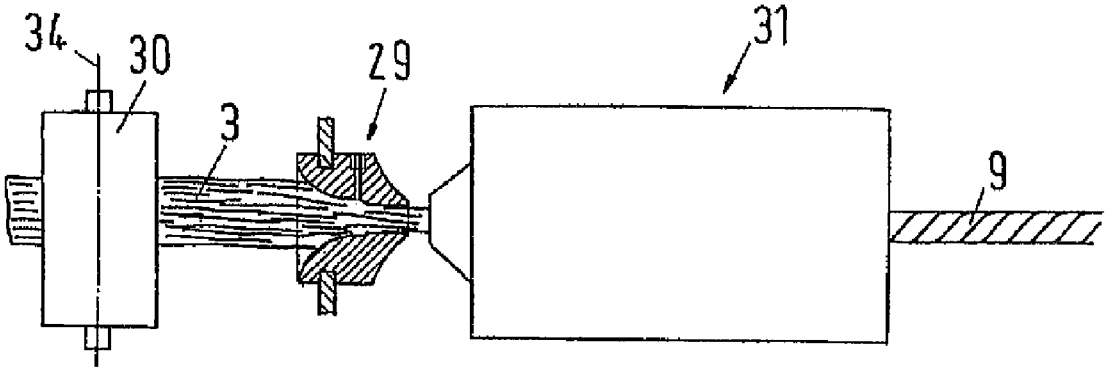
FIG. 9 shows a funnel used to restrict the width of a fiber assembly as the fiber assembly is led to a twist application component.

A slubbing machine according to an exemplary embodiment of the present disclosure may also include a funnel or an aerodynamic or mechanical condenser, which has the function of restricting the width of the fiber assembly as it is led to a twist application component. FIG. 9 depicts a funnel 29 used to restrict a fiber assembly 3 in its width as the fiber assembly 3 is led to a twist application means 31. Such a funnel 29 or other condenser may be arranged downstream of a pair of delivery rollers 30. The pair of delivery rollers 30 is shown in a plan view. The reference number 34 indicates the nip line of the pair of delivery rollers 30.

LEGEND

1 Spinning position of a slubbing machine
2 Drafting device
3 Fiber assembly
4 Twist application component
5 Swirl chamber
6 Roving yarn formation element (spindle)
7 Winding device
8 Pair of delivery rollers
9 Roving yarn
10 Fiber guide element
11 Nozzles
12 Free fiber ends
13 Intake aperture
14 Core
15 Twist application component without roving yarn formation element
16, 16.1, 16.2 Airflow
17 Twist application component with two swirl chambers
18 Twist application component with twist stop
19 Pin
20 Air flow
21 Toroidal fiber guide element with pin
22 Toroidal fiber guide element without pin
23 Fiber guide element with several deflection means
24 Twist stop cone
25 Fiber guide element
26,27,28 Deflection surfaces with twist stop function
29 Funnel
30 Pair of delivery rollers
31 Twist application means
32 Air flow
33 Edge
34 Nip line

The invention claimed is:

1. A slubbing machine for manufacturing a roving yarn from a fiber assembly, said fiber assembly comprising a plurality of individual free fiber ends surrounding a core, said slubbing machine comprising:

at least one spinning position, said spinning position comprising a twist application component comprising:

a swirl chamber comprising a roving yarn formation element having an inlet aperture;

at least one twist stop element within the twist application component;

a fiber guide element with which the fiber assembly is delivered into the swirl chamber; and a fluid device and at least one nozzle hole to create a swirl air flow in said swirl chamber;

wherein said fiber assembly is at least partially subjected to a true twist inside said swirl chamber such that said swirl air flow inside said swirl chamber causes said individual free fiber ends of said fiber assembly to lie around said inlet aperture of said roving yarn formation element and to be taken up by said rotating swirl flow to rotate around said core of said fiber assembly.

2. The stubbing machine of claim 1, wherein the roving yarn formation element is a spindle.

3. The slubbing machine of claim 1, wherein the twist stop is an edge.

4. The stubbing machine of claim 1, wherein the twist stop is a pin.

5. The stubbing machine of claim 1, wherein the twist stop is a toroidal surface.

6. The slubbing machine of claim 1, wherein the twist stop is a deflection surface.

7. The slubbing machine of claim 1, wherein the twist application component comprises a plurality of nozzles for the production of air jets, the nozzles being arranged so that said air jets are produced in the same direction to form a single, unidirectional airflow.

8. The slubbing machine of claim 7, wherein the plurality of nozzles are arranged rotationally symmetrically.

9. The slubbing machine of claim 1, wherein the spinning positions further comprise a funnel upstream of the twist application component and the fiber assembly defines a width, said funnel configured to restrict the width of the fiber assembly as it is led to a twist application component.

10. The stubbing machine of claim 1, wherein the slubbing machine further comprises a winding device located downstream of the twist application component.

11. The stubbing machine of claim 10, wherein the winding device is a cross-winder.

12. The slubbing machine of claim 10, wherein the winding device is a parallel winder.

13. The stubbing machine of claim 1, wherein the twist application component has an inlet, the spinning position has a nip line and the fiber assembly defines a length, said inlet of said twist application component being at a distance from said nip line not greater than the length of the fiber assembly.

14. The stubbing machine of claim 1, wherein the roving yarn formation element has an inlet, the spinning position has a nip line and the fiber assembly defines a length, said inlet of said roving yarn formation element being at a distance from the nip line not greater than the length of the fiber assembly.

15. The stubbing machine of claim 1, wherein said twist is a protective twist, the result of which the roving yarn remains capable of being drafted.

16. A method of manufacturing a roving yarn from a fiber assembly, said fiber assembly comprising a plurality of individual fiber ends surrounding a core, the method comprising:

drafting said fiber assembly;

delivering said fiber assembly into a twist application component comprising:

a swirl chamber comprising a roving yarn formation element having an inlet aperture;

at least one twist stop element within the twist application component a fiber guide element with which the fiber assembly is delivered into the swirl chamber; and a fluid device and at least one nozzle hole to create a swirl air flow in said swirl chamber; and at least partially subjecting said fiber assembly to a true twist application such that said swirl air flow inside said swirl chamber causes said individual free fiber ends of said fiber assembly to lie around said inlet aperture of said roving yarn formation element and to be taken up by said rotating swirl flow to rotate around said core of said fiber assembly.

17. The method of manufacturing a roving yarn of claim 12, wherein said air flow is produced by a plurality of nozzles that produce air jets, said plurality of nozzles being arranged so that said air jets form a single, unidirectional airflow.

* * * * *

UNITED STATES PATENT AND TRADEMARK OFFICE

CERTIFICATE OF CORRECTION

PATENT NO. : 7,661,259 B2
APPLICATION NO. : 10/571416
DATED : February 16, 2010
INVENTOR(S) : Griesshammer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 693 days.

Signed and Sealed this

Thirtieth Day of November, 2010

David J. Kappos

David J. Kappos
*Director of the United States Patent and Trademark Office*